US009109794B2

(12) United States Patent
Kah et al.

(10) Patent No.: US 9,109,794 B2
(45) Date of Patent: Aug. 18, 2015

(54) STEAM GENERATOR

(75) Inventors: Michael Kah, Aspendale (AU); Khaliq Ahmed, Rowville (AU); Geoffrey James Mentink, Warrandyte (AU); Nicholas Victor Orr, Auckland (NZ); Brian Parris, Oakleigh (AU); Richard James Payne, Warrandyte (AU); Daniel Michael Xerri, Richmond (AU)

(73) Assignee: CERAMIC FUEL CELLS LIMITED, Noble Park, Victoria (AU)

( * ) Notice: Subject to any disclaimer, the term of this patent is extended or adjusted under 35 U.S.C. 154(b) by 2151 days.

(21) Appl. No.: 11/988,887

(22) PCT Filed: Jul. 18, 2006

(86) PCT No.: PCT/AU2006/001014

§ 371 (c)(1),
(2), (4) Date: Aug. 20, 2010

(87) PCT Pub. No.: WO2007/009176

PCT Pub. Date: Jan. 25, 2007

(65) Prior Publication Data

US 2010/0304227 A1 Dec. 2, 2010

(30) Foreign Application Priority Data

Jul. 19, 2005 (AU) ..... 2005903813
Aug. 5, 2005 (AU) ..... 2005904252

(51) Int. Cl.
*F22D 7/00* (2006.01)
*F22B 1/00* (2006.01)

(52) U.S. Cl.
CPC ..... *F22B 1/003* (2013.01)

(58) Field of Classification Search
USPC ..... 122/406.1–406.3, 414, 415; 429/400
See application file for complete search history.

(56) References Cited

U.S. PATENT DOCUMENTS

| | | | | |
|---|---|---|---|---|
| 3,267,678 | A | 8/1966 | Camp | |
| 3,945,210 | A | 3/1976 | Chapin | |
| 4,842,055 | A * | 6/1989 | Ohtsu | 165/174 |
| 5,159,897 | A | 11/1992 | Franke et al. | |
| 5,167,907 | A * | 12/1992 | Mauget et al. | 376/260 |
| 6,259,760 | B1 * | 7/2001 | Carelli et al. | 376/346 |

(Continued)

FOREIGN PATENT DOCUMENTS

| | | | |
|---|---|---|---|
| CN | 2298466 | Y | 11/1998 |
| DE | 198 00 017 | A1 | 7/1999 |
| EP | 1 319 890 | A2 | 6/2003 |

(Continued)

OTHER PUBLICATIONS

Kandlikar, Satish G., Experimental Thermal and Fluid Science, vol. 26, pp. 389-407, (2002).

(Continued)

*Primary Examiner* — Gregory A Wilson
(74) *Attorney, Agent, or Firm* — Birch, Stewart, Kolasch & Birch, LLP.

(57) ABSTRACT

A method of generating steam by heating water in a steam generator comprising a plurality of steam generating channels, wherein water is supplied at a constant rate to each steam generating channel through respective water supply lines, and wherein a sufficient pressure drop is provided across each water supply line in order to prevent flow reversal in the plurality of steam generating channels.

21 Claims, 3 Drawing Sheets

(56) References Cited

U.S. PATENT DOCUMENTS

| | | | | |
|---|---|---|---|---|
| 6,868,807 | B2 | 3/2005 | Franke et al. | |
| 7,281,499 | B2 * | 10/2007 | Franke et al. | 122/406.5 |

FOREIGN PATENT DOCUMENTS

| | | | |
|---|---|---|---|
| JP | 2001-124324 | | 5/2001 |
| JP | 2002-021509 | | 1/2002 |
| JP | 2002-317651 | | 10/2002 |
| WO | WO-2005/120225 | A1 | 12/2005 |
| WO | WO-2006/010212 | A1 | 2/2006 |

OTHER PUBLICATIONS

Extended European Search Report issued in European Patent Application No. 06760875.2 on Apr. 14, 2014.

* cited by examiner

STEAM GENERATOR

FIELD OF THE INVENTION

The present invention relates to a method of generating steam and to a steam generator system suitable for use in the method. The present invention also provides application of the method and steam generator system in a fuel cell system and to a fuel cell system in which steam is generated in accordance with the method or by using the steam generator system.

The present invention will be described and illustrated with reference to fuel cell systems as these are the preferred context for implementation of the invention. However, the underlying principles of the present invention are believed to be more generally applicable and the invention may therefore be applied to systems other than fuel cell systems.

BACKGROUND TO THE INVENTION

In the purest form of the reaction, fuel cells produce electricity from hydrogen and oxygen with water being produced as a by-product in the form of steam. However, hydrocarbon fuels such as natural gas or higher ($C_{2+}$) hydrocarbons are commonly used as the source of hydrogen and air is used as the source of oxygen.

Prior to delivery to the fuel cell, it is now conventional to process hydrocarbon fuel to a lesser or greater extent using a fuel reformer. Thus, in proton exchange membrane (PEM) type fuel cells, it is intended that the hydrocarbon fuel undergoes substantially complete ireformation by reaction with water (steam) in order to produce a hydrogen-rich stream for delivery to the fuel cell. In contrast, in solid oxide fuel cell (SOFC) systems it is possible to use catalysts within the fuel cell itself (on the anode side of the fuel cell) to effect reforming of hydrocarbons (usually methane). So-called internal reforming in this way has advantages for operating efficiency in terms of balancing the exothermic electricity-generating reactions that occur within the fuel cell with the endothermic reforming reaction. However, in this case the fuel composition to the fuel cell and the extent of internal reforming within the cell should be controlled to avoid excessive cooling of the fuel cell. In practice, where a fuel cell is designed to carry out internal reforming, the fuel to be delivered to it is pre-processed in a fuel reformer in order to manipulate the hydrocarbon content of the fuel as required based on the operating characteristics of the cell. Here the reformer is typically referred to as a steam pre-reformer.

Hydrocarbon reforming takes place in the presence of steam, and the steam to carbon ratio in the gas stream to the reformer is one of the most critical variables in the reforming reaction. Furthermore, the presence of steam in the fuel stream to the fuel cell can prevent carbon deposition on the catalyst used to effect internal reforming. Accurate control of the steam to carbon ratio is therefore an important consideration.

It is also important for effective and efficient operation of a fuel reformer that the steam and fuel to be processed are delivered at a suitable rate/pressure. A non-uniform hydrocarbon flow rate will lead to changing fuel utilisation and this may be detrimental to the fuel cell stack of the system. If a steam venturi (ejector) is used to entrain the hydrocarbon fuel, a change in the steam flow rate to the venturi will immediately change the fuel uptake/flow rate. If natural gas is delivered by a blower for example, a change in steam flow rate will change the back-pressure of the system and this will alter the fuel flow rate to the system.

Invariably, in conventional systems the steam is delivered to the reformer under pressure from a steam generator. The steam flow rate that is required is very low by normal industrial standards (typically it is about 1 kg/hr at most for a 2 kW fuel cell system) and to account for this the steam generator typically consists of a number of small bore tubes that are supplied with water and heated. This approach for generating steam is generally referred to as flow boiling.

Whilst generally useful, production of steam in this manner can lead to pressure and flow fluctuations (or pulses) and, often, reverse flow in the tubing used for generating the steam. These effects have been reported in relation with the use of mini-channels (200 μm-3 mm diameter) and micro-channels (<200 μm diameter) for steam generation. In the case of mini-channels the oscillatory nature with which the steam is generated and the occurrence of reverse flow are believed to be due to a variety of mechanisms with the nucleation of bubbles being a significant factor. More particularly, three flow patterns are believed to be common to flow boiling in mini-channels: isolated bubble flow; confined bubble flow; and annular-slug flow (see S. G. Kandlikar, Fundamental issues related to flow boiling in mini-channels and micro-channels, Experimental Thermal and Fluid Science 26 (2002) pp 389-407). The mechanism(s) in operation for flow boiling in micro-channels is less well understood although surface tension effects are believed to be significant (see the article by S. G. Kandlikar as referenced).

Irrespective of the reasons why pressure fluctuations and reverse flow occur, when steam is generated in the manner described these effects can present problems in fuel cell systems. In addition to the abovementioned non-steady entrainment of fuel in a steam venturi used to entrain the fuel, pressure pulses associated with steam production may extend throughout the fuel cell system and adversely affect components as a result. For example, pressure pulses associated with steam generation can be experienced as far downstream in the fuel cell system as the burner used to burn (anode) exhaust from the fuel cell, and here the pulses can cause problems with consistency of burner operation.

Against this background, it would be desirable to provide a method of generating steam in a stable manner and at a more uniform flow rate than provided by existing steam generators. Such a method would not suffer the disadvantages described above.

SUMMARY OF THE INVENTION

Accordingly, the present invention provides a method of generating steam by heating water in a steam generator comprising a plurality of steam generating channels, wherein water is supplied at a constant rate to each steam generating channel through respective water supply lines, and wherein a sufficient pressure drop is provided across each water supply line in order to prevent flow reversal in the plurality of steam generating channels.

In accordance with the present invention steam is generated in a plurality of channels of the steam generator by flow boiling of water supplied to the channels. This would normally result in pressure and flow fluctuations including flow reversal against the direction of water supply. Normally, this would impede the supply of water to the steam generator thereby leading to fluctuations in steam output. Flow reversal in one steam generating channel may also influence steam production in adjacent channels (assuming that that channels are not physically isolated from each other). In accordance with the present invention flow reversal is minimised, or preferably avoided altogether, by supplying water to the steam generator in a particular manner.

Specifically, in accordance with the present invention, each steam generating channel is supplied with water through individual water supply lines and these water supply lines are designed to exhibit a particular pressure drop across their length (from inlet to outlet). It has been found that if this pressure drop is sufficiently large (relative to the pressure drop across the steam generator), flow reversal in the steam generating channels can be minimised and possibly prevented. In this context the pressure drop across the water supply line is the difference in pressure between the inlet and outlet of the line. Similarly, the pressure drop across the steam generator is the difference in pressure between the inlet and outlet of the generator. To be more precise it is believed that benefits in terms of reduced flow reversal may be achieved at a particular ratio of pressure drop across each water supply line ($\Delta P_{supply}$) to the pressure drop across the steam generator ($\Delta P_{generator}$), ie $\Delta P_{supply}:\Delta P_{generator}$. It is believed that when this ratio is too low, the pressure drop across each water supply line is not sufficient to prevent flow reversal in the steam generating channels. As a general guide, it is believed that the ratio $\Delta P_{supply}:\Delta P_{generator}$ should be from 1:2 to 1:5, preferably about 1:3, to minimise or avoid flow reversal.

The pressure drop across the steam generator and each water supply line will be dependent on the design/construction of these components. Typically, the pressure drop required across each water supply line will be determined based on the design (and pressure drop characteristics) of the steam generator to be used. Thus, the choice of steam generator tends to drive the design of the water supply lines (to achieve the requisite pressure drop) rather than vice versa. The pressure drop across these components, and the variation of pressure drop with flow rate, may be determined experimentally using suitably positioned pressure transducers and one skilled in the art would be familiar with how to do this. It may also be possible to calculate the pressure drop based on the known behaviour of certain components that may be used in the present invention. For example, the pressure drop associated with capillary tubing may be calculated based on the dimensions of the capillary. Adjustments may of course be required to achieve optimum performance.

In principle, the pressure drop in each water supply lines can be achieved by using a suitably positioned throttle valve, or other suitable flow restriction device. Throttle valves that may be used are known in the art. It should be noted however that the pressure drop for a throttle valve follows a squared relationship with flow rate and it may be difficult to achieve the requisite pressure drop at low flow rates.

It is preferred however that the pressure drop across each water supply line follows a linear relationship with flow rate. In this case turn down of the steam generator will be improved since at low flow rates the associated pressure drop across the water supply lines will be higher than that which would otherwise be observed using a device such as a throttle valve where the pressure drop follows a squared relationship with flow rate. It is also preferred that the pressure drop across the steam generator follows a linear relationship with flow rate. In this case the ratio $\Delta P_{supply}:\Delta P_{generator}$ will remain essentially constant irrespective of variations in the flow rate so that, provided this ratio is suitably applied in the first place, it should be possible to avoid flow reversal over a range of operating parameters for steam generation.

The present invention may be implemented for any internal diameter of steam generating channel that results in pressure and flow fluctuations when steam is generated in the channel. Thus, the steam generating channels are typically channels having an internal diameter of less than 5 mm. The channels may be mini-channels having an internal diameter of 200 μm-3 mm and/or micro-channels having an internal diameter of less than 200 μm. The exact form that these channels take may vary as between different designs of steam generator, as will be discussed below.

For steam generating channels having an internal diameter of up to about 5 mm, the pressure drop across each water supply line may be achieved by delivering water to (the inlet of) each steam generating channel through a water supply line having a (significantly) smaller internal diameter than the steam generating channel. Preferably, this is done using capillary tubing to supply water to each steam generating channel. As noted, use of capillary tubing in this way is especially advantageous since it gives a linear pressure drop with flow rate (low Reynolds number). A capillary can advantageously provide a more significant pressure drop at low flow rates than other flow control devices that exhibit a squared relationship with respect to pressure drop and flow rate.

The dimensions of the capillary tubing (length and internal diameter) to be used will depend upon the pressure drop required across each water supply line and in turn this will depend upon the pressure drop associated with operation of the steam generator. One skilled in the art would understand how the dimensions of capillary tubing influences pressure drop associated with liquid flow through such tubing.

It is also important in accordance with the present invention that water is supplied to each water supply line at a constant (but adjustable) rate in order to minimise fluctuations in steam production. In accordance with the present invention this may be achieved using a flow control valve. Typically, a single valve controls the combined flow of water to each and every water supply line. The valve is typically provided in a main supply line with each water supply line being branches from this main supply line. Preferably, there are no differences in supply pressure as between each water supply line. The flow control valve ensures uniform supply of water and it is important that it does not suffer back pressure effects due to flow reversal in the steam generating channels of the steam generator. The pressure drop provided across the water supply lines is intended to ensure that the water supply remains constant.

It is preferred that during operation of the steam generator the water supply lines to the steam generator are at essentially constant temperature as temperature fluctuations may influence the pressure drop across the water supply lines. To this end it is preferred that the water supply lines are thermally insulated from the downstream steam generator. This may be achieved by providing a suitable insulating connector between the outlet of each water supply line and the inlet of each steam generating channel and/or by the use of suitably positioned thermal insulation.

The steam generator used in accordance with the present invention includes a plurality of steam generating channels. The number of channels may vary depending upon the overall design of the steam generator and on the desired effect associated with the invention of neutralising pressure fluctuations when steam is generated. In principle, the steam generator could include 2 steam generating channels, although it is likely that more than 2 channels will be used since a greater number of channels will lead to a more efficient neutralisation of pressure fluctuations in the steam that is generated. Thus, the steam generator will generally include at least 3, preferably at least 5 and, more preferably, at least 10 steam generating channels. Other factors, such as required flow rate, the maximum pressure drop that can be tolerated and cost, are also likely to influence the design of the steam generator used in practice of the invention. The steam generating channels are usually minichannels and/or microchannels as described.

In one embodiment of the invention the plurality of steam generating channels take the form of discrete tubes (defining micro-channels and/or mini-channels). Typically, the tubes are arranged co-axially. With this arrangement it may be possible to use a single heat source to supply heat to all the channels for steam generation. Furthermore, this arrangement may be beneficial from a manufacturing and/or installation perspective.

In this embodiment, typically, the length to diameter ratio of the steam generating channels is from 250:1 to 750:1, for example about 500:1. From a cost (and packaging) perspective it may be beneficial to minimise this ratio. Technically, the ideal ratio to use is likely to depend upon steam generator requirements such as maximum pressure drop tolerated by the system, heat flux into the steam generator, maximum tolerated pressure and flow fluctuations.

In another embodiment the steam generating channels may be defined by the surfaces of plates or sheets that are bonded together to form a laminate. In this case at least one of the plates or sheets is etched, engraved or machined at a (major) surface so that abutment of that surface to a complementary (major) surface of another plate/sheet results in the production of steam generating channels extending internally across the length (or width) of the laminate with the inlets and outlets of the channels being provided at an edge or edges, preferably opposite edges, of the laminate. For use in a fuel cell system the laminate should be compact. By way of example, the laminate may be formed of (heat resistant steel) plates/sheets having dimensions 10-15 cm by 5-10 cm by 1-2 mm. Typically, the channels will have dimensions specified above for mini- and micro-channels. The production of laminate devices of this type is known in the art.

In the laminate the steam generating channels may take a variety of configurations. In the simplest form the laminate may include a plurality of parallel (straight) steam generating channels extending internally across the laminate. Other designs are however possible and the configuration of steam generating channels may help to minimise pressure fluctuations in the steam generator during production.

In an embodiment of the invention the steam generator may comprise a plurality of such laminates arranged in the form of a stack. Heating of the steam generator is achieved using a gas stream at elevated temperature. In such a stack, adjacent laminate structures are commonly separated in the stack by a finned plate or sheet that is adapted to allow hot gas to flow through the stack for heat transfer. The waste heat from an exhaust stream from the fuel cell or the burned off gas from the fuel cell (when operational) may be used in this regard.

Irrespective of the design of steam generator used, in the plurality of steam generating channels individual channels may be the same or different. It may benefit the intended reduction of pressure pulses for not all of the channels to be the same. Likewise it may be beneficial for different channels to experience a different heating effect when the steam generator is being used.

It is believed that use of multiple steam generating channels may lead to an averaging out of pressure pulses associated with individual channels such that the overall pressure fluctuation is dampened. Without wishing to be bound by theory, it is believed that when using multiple steam generating channels it is unlikely that a trough or peak in steam pressure at the outlet of one channel will be in synchrony with a respective trough or peak in steam pressure at the outlet of other channels. Thus, it is believed that the pressure fluctuation associated with one steam generating channel may mitigate or cancel the steam fluctuation associated with other steam generating channels.

In accordance with an embodiment of the present invention the steam generator delivers steam (from each steam generating channel) into a steam receiving vessel that comprises a steam outlet extending therefrom and that is adapted to dissipate or equilibrate fluctuations in the pressure of steam delivered into the vessel so as to provide a uniform steam pressure at the steam outlet. In accordance with this embodiment of the invention the potentially detrimental effects associated with pressure fluctuations may be minimised, and preferably avoided, by using a steam receiving vessel that is configured to dissipate pressure pulses of steam delivered into the vessel from the individual steam receiving channels so that reduced pressure pulses, and preferably no pressure pulses, are observed at the steam outlet of the vessel.

The form of steam receiving vessel used in accordance with this aspect of the invention is believed to have a significant influence on reducing pressure fluctuations in steam output of the steam generator. More particularly, the size and/or shape of the vessel is/are such that any pressure fluctuations in the steam delivered into the vessel from the steam generating channels are accommodated so that the steam pressure at the steam outlet is uniform and stable. The position of the steam outlet may also be significant in this regard. Thus, the steam outlet from the vessel is typically remote from the location at which the steam channels deliver steam into the steam receiving vessel. In this context the term "remote" means that the steam outlet extends from the steam receiving vessel at a location where any pressure fluctuations associated with delivery of steam into the vessel are not significant.

The steam receiving chamber preferably has an internal volume that is of several orders of magnitude (for example, at least 25 fold, preferably at least 100 fold) greater than the total volume of the steam generating channels. This may help to absorb and equilibrate the oscillatory nature with which steam is delivered into the vessel from the steam receiving channels. The effective volume of the steam receiving chamber may be less when a large number of steam generating channels are used, and vice versa. This is because the use of a large number of steam generating channels may lead to increased dampening of pressure pulses so that the effective volume of the steam receiving vessel to achieve further dampening may not need to be as large. The effective volume required for the steam generating vessel can be determined and optimised by experiment. The volume of the vessel is much larger than the normal header or end space that one might expect to find in a conventional boiler system.

Preferably, the internal surfaces of the steam generating channels and of the steam receiving vessel are smooth and clean. Furthermore, the internal surfaces of the steam receiving vessel are rounded rather than including sharp or acute corners. A specially designed internal surface in the steam receiving vessel may be used to absorb pressure fluctuations. In turn, this may enable the volume of the steam receiving vessel to be reduced.

The (outlets of the) steam receiving channels are usually attached to the steam receiving vessel by means of a channel receiving plate that preferably forms part of the vessel wall. Any and all seams are pressure tight and smooth at least on the internal steam contacting surfaces.

In use heat is supplied to the steam generating channels so that when water is pumped through the channels it vaporizes thereby forming steam. Heat may be supplied to the channels in a variety of ways. For example, where the channels are co-axial, they may extend through a block of material that may be heated. Alternatively, the channels may be wrapped around a heated component, such as a hot pipe or electrical heater, or they may be exposed directly to a burner or wrapped around a burner case. Heated air may also be used to heat the steam generator and here the steam generator may be adapted to ensure intimate contact with air flow to enhance heat transfer. Preferably, the heater source and channels are arranged to minimise heat loss. Water is supplied to the channels under pressure. Pure water should be used to minimise deposition and corrosion problems.

In a steam generator for use in a solid oxide fuel cell system, steam will typically be delivered into the steam receiving vessel at a pressure of from about 1 to about 5 bars, for example at about 3 bars, and a temperature of about 600° C. The rate of steam supply is usually required to be up to about 1 kg/hr, for example up to about 500 g/hr, and the steam generator may be designed and operated accordingly. It will be appreciated from that this implies a relatively low volume of water usage for operation of the steam generator. The rate of steam production may be manipulated by varying the rate of water supply to one or more of the channels, preferably by varying the rate of water supply to all the channels at once. The operating characteristics of the steam generator will vary depending upon the field of use. Thus, for other applications the pressure and temperature conditions may be different from those mentioned.

The components of the steam generator must be formed of suitable materials to withstand elevated temperatures and pressures likely to be encountered during operation. One skilled in the art will be familiar with the types of materials to use in implementation of the present invention.

The present invention also provides a steam generator system suitable for implementation of the method of the invention as described, the system comprising:

a steam generator comprising a plurality of steam generating channels, water supply lines in communication with respective steam generating channels for supplying water to the steam generating channels, wherein each water supply line includes means for providing a pressure drop across each water supply line in order to prevent flow reversal in the plurality of steam generating channels during operation of the steam generator.

Embodiments of the steam generating system will be apparent from the foregoing discussion relating to the method of the present invention. In one preferred embodiment the pressure drop across each water supply line is achieved using capillary tubing. Water may be delivered to each water supply line using an upstream flow control valve in order to provide a constant (but adjustable) water flow rate.

The steam generating system may also comprise a steam receiving vessel that is adapted to receive steam from the steam generating channels of the steam generator and that is intended to dissipate fluctuations in steam pressure pulses. Embodiments of this aspect as also as described above.

The present invention also provides a fuel cell system in which steam is generated in accordance with the method of the invention as described herein. The invention further provides a fuel cell system comprising a steam generator system in accordance with the invention as described herein. The fuel cell system will typically utilise steam for fuel processing of hydrocarbon fuel in order to generate a fuel stream for delivery to the anode of the fuel cell. In an embodiment, steam may be supplied to a venturi that is used to entrain hydrocarbon fuel based on the rate of steam flow through the venturi. Preferably, the fuel cell is a solid oxide fuel cell (SOFC).

In a further embodiment of the invention there is provided a steam generator comprising:

a steam receiving vessel;

a plurality of steam generating channels that are in communication with the steam receiving vessel and that are adapted to deliver steam into the steam receiving vessel; and a steam outlet extending from the steam receiving vessel, wherein the steam receiving vessel is adapted to equilibrate fluctuations in the pressure of steam delivered into the vessel by the plurality of steam generating channels so as to provide a uniform steam pressure at the steam outlet.

Embodiments of this aspect of the invention will be apparent from the preceding description.

BRIEF DESCRIPTION OF THE DRAWINGS

Embodiments of the present invention are illustrated in the following non-limiting drawings in which.

DESCRIPTION OF THE PREFERRED EMBODIMENT AND OTHER EXAMPLES OF THE INVENTION

Figure 1:
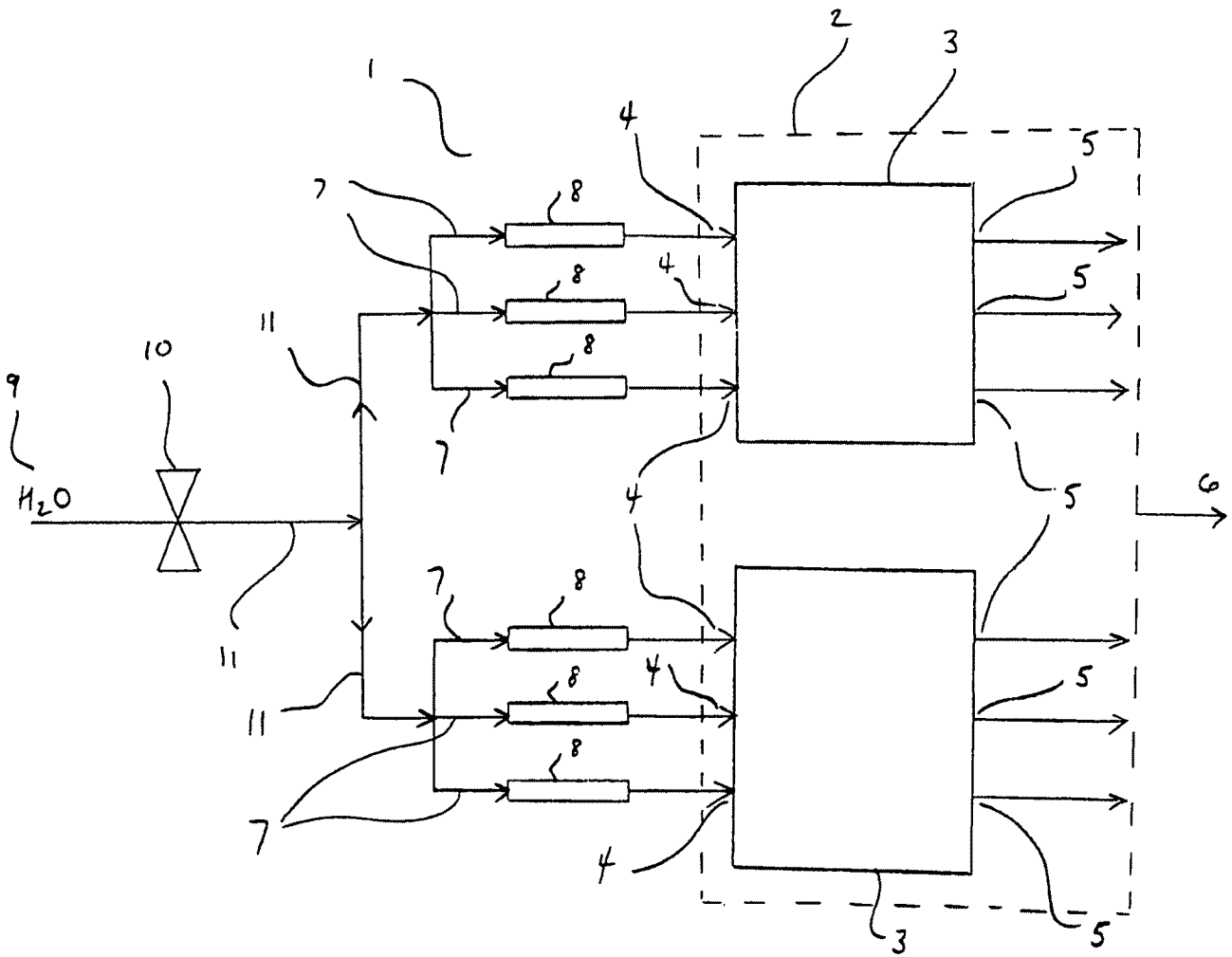
FIG. 1 is a schematic illustrating steam generation according to an embodiment of the invention.

FIG. 1 shows as a schematic a steam generator system (1) comprising a steam generator (2). The steam generator includes two laminate steam generator units (3) comprising a plurality of steam generating channels (not shown) extending internally across the units (3). Each unit includes inlets (4) for supplying water to the respective steam generating channels and steam outlets (5). The steam generator includes an outlet (6) through which steam generated by the individual units is delivered. The outlet (6) may deliver steam into a steam receiving vessel (not shown) if it is desired to dampen pressure fluctuations in the steam that is produced, as described herein. As an alternative, the outlet of individual steam generating channel may feed steam into a steam receiving vessel directly rather than through a single outlet of the steam generator. This may provide advantages in terms of the averaging out effect on fluctuations in steam production.

The use of a steam receiving vessel may not be essential if the steam produced (i.e. the output of the steam generator) is at a stabilised and uniform rate. In this case the output of the steam generator may be used directly in downstream components of a fuel cell system.

Figure 2:
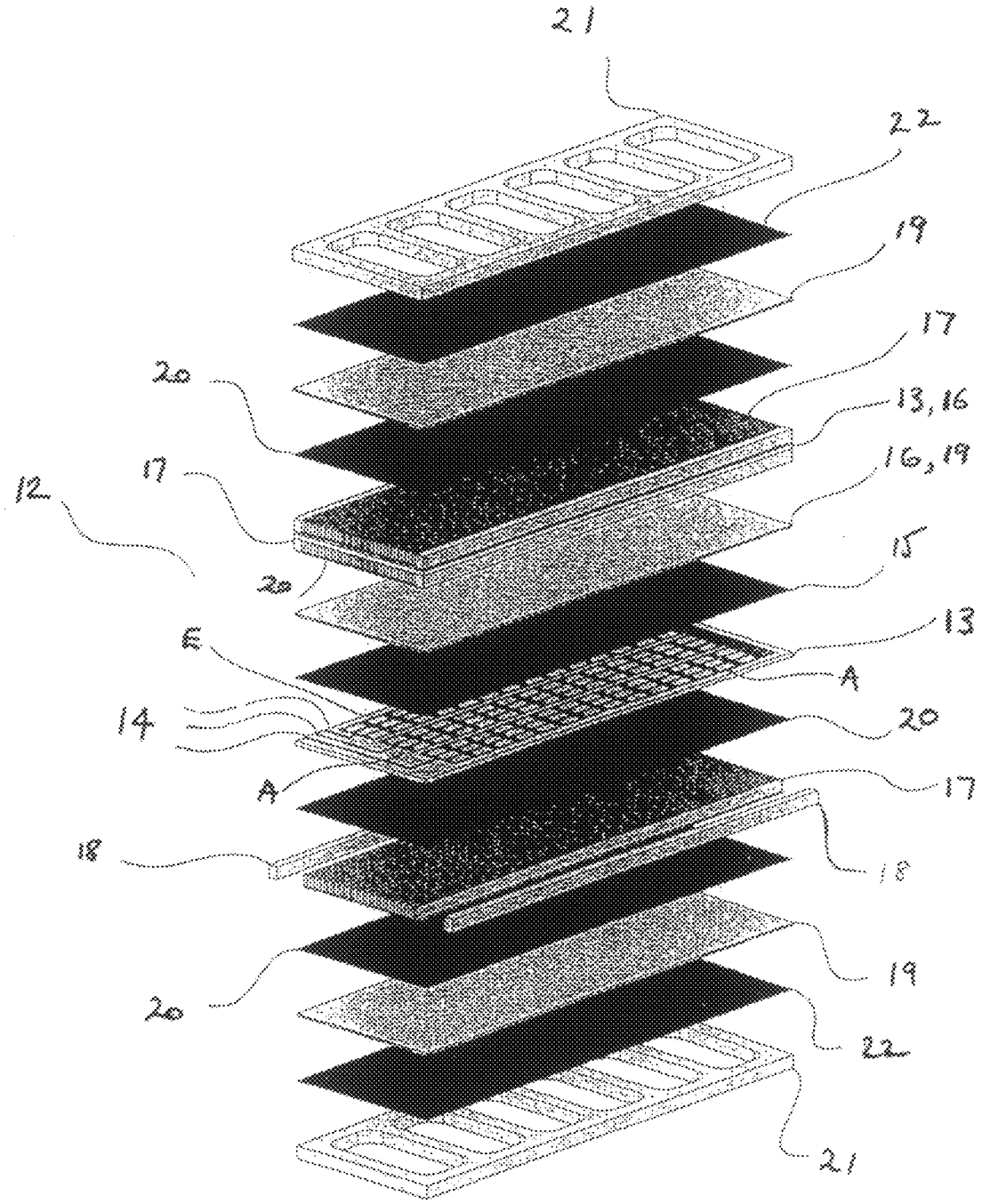
FIG. 2 is an exploded view illustrating a steam generator stack useful in implementation of the present invention.

The units (3) may be provided in the form of a stack (see FIG. 2).

Water is supplied to each steam generating channel through respective water supply lines (7), each of which includes a capillary (8) in order to provide a pressure drop across the water supply lines (7). This pressure drop is required to be sufficient, relative to the pressure drop across the steam generator (2), to prevent flow reversal in the water supply lines (7) when the steam generator (2) is operated.

In turn the water supply lines (7) receive water from a supply (9) and this supply is metered at a constant rate using a flow control valve (10) provided in a main supply line (11). The individual water supply lines (7) are branches from this main supply line (11). It is important that the flow rate of water along each water supply line (7) is constant.

FIG. 2 is an exploded view of a steam generator stack (12) useful in implementation of the present invention. The stack (12) includes a high temperature resistant steel plate (13) that is etched/engraved/machined on a major surface thereof to provide a plurality of steam generating channels (A). The inlet (14) of each steam generating channel is provided at an edge (E) of the plate. The outlet of the steam generating channels (not shown in detail) is also provided at an edge of the plate (13). The inlet (14) and outlet of each steam generating channel may be provided on the same or different edges of the plate (13). A foil (15) of a suitable brazing material enables the major surface of another plate (16) to be bonded to the plate (13). The complementary major surface of this plate (16) is smooth. The result will be a laminate (13, 16) in which the steam generating channels extend internally across the laminate. The brazing material does not impede the steam generating channels once the laminate (13, 16) has been formed.

The stack (12) also includes a heat transfer component (17) in the form of a corrugated plate that is bonded by its edges by side members (18) and at its upper and lower surfaces to adjacent plates (19), using foils (20) of a suitable material to achieve bonding. The heat transfer component (17) is designed to allow air to be passed through the stack thereby allowing heat transfer to the laminate including the plate (13). Additional end plates (21) are bonded to the upper and lower ends of the stack (12) using suitable brazing foils (22). These end plates may contribute structural rigidity to the stack.

The materials used in construction of the stack are selected based on their intended use and conditions that will be encountered, including the temperature of the steam that is generated and the temperature and composition of the gas stream used to heat the stack. Typically, high temperature alloys may be used to form the steam generator (13, 16) and heat transfer component (17), for example alloys under the designation INCONNEL. The steam generator (13, 16) may be formed from INCONNEL 600 and the heat transfer component may be formed from INCONNEL 625.

Figure 3:
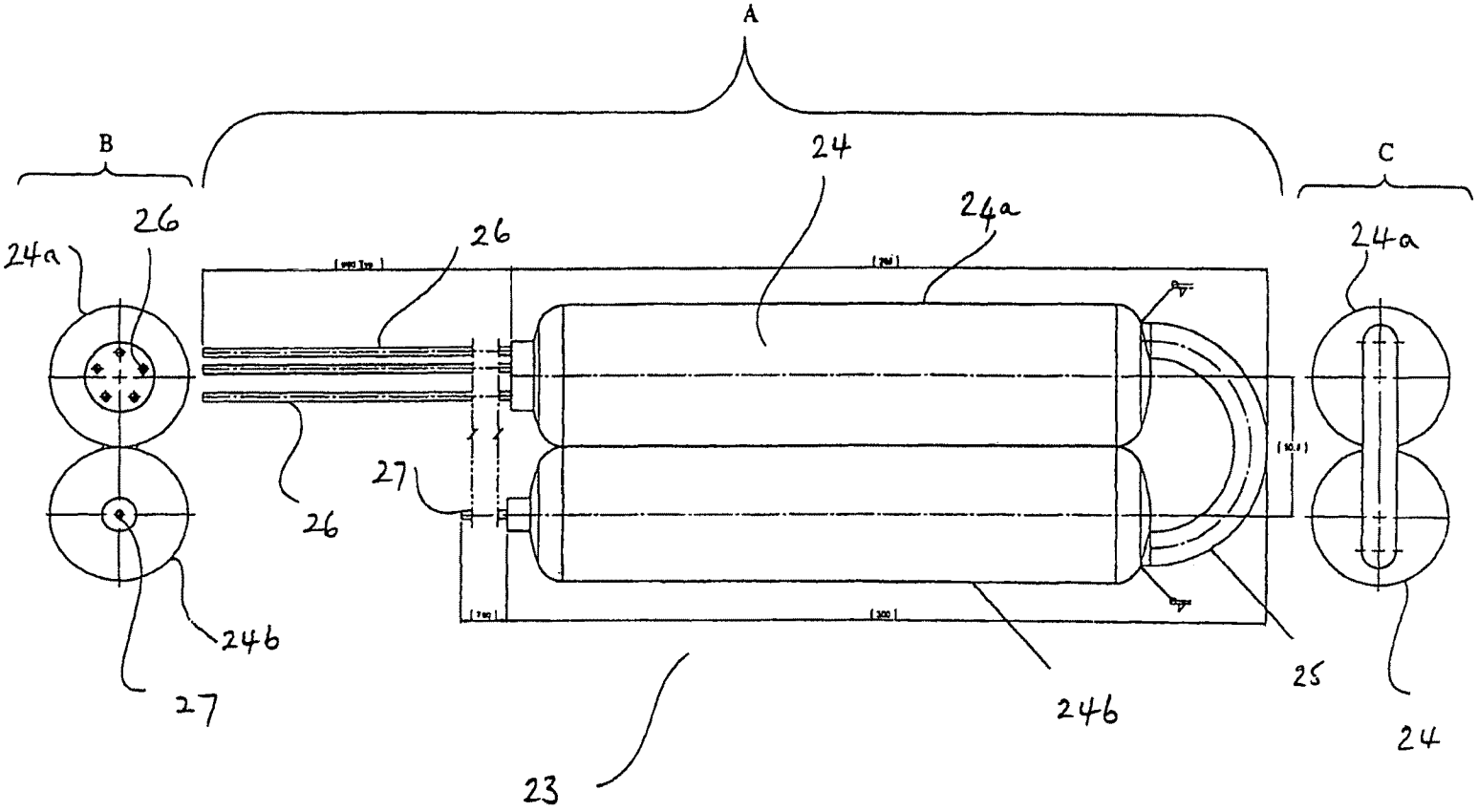
FIG. 3 is an engineering drawing illustrating aspects of another steam generator system according to the present invention.

FIG. 3 is an engineering drawing of an alternative steam generator in accordance with the present invention. The steam generator is suitable for use in a fuel cell system rated at about 1 kw. View A of the Figure shows a longitudinal view with views B and C being respective end views. The Figure shows a steam generator (23) comprising a steam receiving vessel (24) in the form of two cylindrical chambers (24*a*, 24*b*) the interiors of which are corrected by a U-tube connector (25). This design provides a compact vessel having the same internal volume as a single, longer vessel of the same internal diameter. The use of two interconnected chambers (24*a*, 24*b*) is especially useful in the context of a fuel cell application where the space occupied by components tends to be a critical design aspect. Other designs for the vessel are of course possible provided the vessel functions as intended. Typical dimensions (in mm) are shown on the Figure. The total volume of the steam receiving vessel (24) is approximately 855 $cm^3$ and this would suit a 1 kW electrical generation solid oxide fuel cell system.

The steam generator (23) also includes a plurality of steam generating channels (26). In the embodiment shown there are 5 such channels and they are grouped together surrounding and parallel to a common axis. The channels are formed from Alloy 600 tube and have an internal diameter of approximately 1.5 to 1.7 mm, with a wall thickness of 0.7-0.9 mm. In the embodiment shown the length of the channels (26) is typically 890 mm. Although not shown, a capillary tube (internal diameter 170 μm) joined to the end of each channel (26) delivers water to the channel. This join may be by means of any suitable (reduction) fitting or be achieved by brazing, for example. Useful capillary tubing is commercially available.

The steam receiving vessel (24) also includes a steam outlet (27) extending from the vessel (24) at a location remote from where the steam generating channels (26) feed into the steam receiving vessel (24).

The steam receiving vessel (24) is formed of Alloy 600 and is produced by welding end caps adapted to receive the steam generating channels (26), the ends of the connector (25) and the steam outlet (27). These components are joined by welding. Prior to welding all components are ultrasonically cleaned and/or cleaned with a suitable detergent. All welds and weld preparations are carried out in accordance with AS 1554.1-1991 GP and welding is undertaken by a certified operator. An argon purge is employed when welding. It is important that all internal surfaces are smooth, free from burrs, drags and welding splatter.

In use the water is delivered under pressure through the capillary tubes and into the steam generating channels (26). The channels are arranged around a burner pipe (not shown) supplying heat to the channels (26). This causes superheating of the water with the result that steam flows under pressure (about 3-4 bar and 700° C.) into the steam receiving vessel (24). It is likely that steam generated in each channel (4) will flow in pulses into the steam receiving vessel (24). However, in the vessel (24) these pulses are believed to neutralize each other thereby providing a uniform steam pressure at the steam outlet (27). Thus, a uniform flow of steam is available via the steam outlet (27). This may be confirmed by high speed data logging of pressures within the system.

The steam generator in accordance with the invention may be used in any system where it is desired to produce a uniform and stable supply of steam. The steam generator may be used in applications where steam is conventionally produced by flow boiling and where problems of pressure fluctuation and/or reverse flow have been observed. It is believed that the steam generator will have particular utility in fuel cell systems where the required steam flow rate is relatively small, typically at most about 1 kg/hr. This would generally imply a fuel cell system rated at about 1 KW. It follows from this that the present invention also extends to the use of a steam generator in accordance with the invention in a fuel cell system and to a fuel cell system comprising such a steam generator.

In the context of a fuel cell system the steam generator of the invention may be used to provide steam for a variety of systems and componentry. By way of example, the steam generator may be used to provide steam to a steam pre-reformer that is used to process higher hydrocarbon fuel used as raw fuel for a fuel cell. In this case steam reforming is generally carried out at a temperature no greater than about 550° C. Preferably, in this context the steam generator is operated such that no significant cooling or heating of its output is required prior to delivery to the pre-reformer.

In another embodiment the steam produced in accordance with the invention may be used to deliver steam to a venturi (ejector or jet pump) that is used to entrain gaseous (hydrocarbon) fuel to produce a fuel/steam mixture. This mixture may be delivered to a steam reformer or to a fuel cell provided downstream. Here reference may be made to Applicant's International patent application no. PCT/2005/001107 (WO 2006/010212) the content of which is hereby incorporated by reference.

Throughout this specification and the claims which follow, unless the context requires otherwise, the word "comprise", and variations such as "comprises" and "comprising", will be understood to imply the inclusion of a stated integer or step or group of integers or steps but not the exclusion of any other integer or step or group of integers or steps.

The reference to any prior art in this specification is not, and should not be taken as, an acknowledgment or any form of suggestion that that prior art forms part of the common general knowledge in Australia.

The invention claimed is:

1. A method of generating steam for use in a fuel cell system, which method comprises heating water in a steam generator comprising a plurality of steam generating channels, wherein water is supplied at a constant rate to each steam generating channel through respective water supply lines, and wherein a sufficient pressure drop is provided across each water supply line in order to prevent flow reversal in the plurality of steam generating channels, wherein the pressure drop across each water supply line is provided delivering water to each generating channel through a capillary.

2. A method according to claim 1 wherein, the pressure drop across each water supply line follows a linear relationship with flow rate.

3. A method according to claim 1, wherein the pressure drop across the steam generator follows a linear relationship with flow rate.

4. A method according to claim 1, wherein the ratio of the pressure drop across each water supply line ($\Delta P_{supply}$) to the pressure drop across the steam generator ($\Delta P_{generator}$) is from 1:2 to 1:5.

5. A method according to claim 1, wherein the water is supplied to each water supply line at a constant rate using a flow control valve.

6. A method according to claim 5, wherein a single valve controls the flow of water to each and every water supply line.

7. A method according to claim 1, wherein the steam generator delivers steam into a steam receiving vessel that comprises a steam outlet extending therefrom and that is adapted to dissipate or equilibrate fluctuations in the pressure of steam delivered into the vessel so as to provide a uniform steam pressure at the steam outlet.

8. A steam generator system comprising:

a steam generator comprising a plurality of steam generating channels; and water supply lines in communication with respective steam generating channels for supplying water to the steam generating channels, wherein each water supply line includes means for providing a pressure drop across each water supply line in order to prevent flow reversal in the plurality of steam generating channels during operation of the steam generator, wherein a capillary is used to provide the pressure drop across each water supply line.

9. A system according to claim 8, wherein the steam generator delivers steam into a steam receiving vessel that comprises a steam outlet extending therefrom and that is adapted to dissipate or equilibrate fluctuations in the pressure of steam delivered into the vessel so as to provide a uniform steam pressure at the steam outlet.

10. A steam generator comprising:

a steam receiving vessel;

a plurality of steam generating channels that are in communication with the steam receiving vessel and that are adapted to deliver steam into the steam receiving vessel; and a steam outlet extending from the steam receiving vessel, wherein the steam receiving vessel is adapted to equilibrate fluctuations in the pressure of steam delivered into the vessel by the plurality of steam generating channels so as to provide a uniform steam pressure at the steam outlet.

11. A fuel cell system comprising a steam generator system comprising:

a steam generator comprising a plurality of steam generating channels; and water supply lines in communication with respective steam generating channels for supplying water to the steam generating channels, wherein each water supply line includes means for providing a pressure drop across each water supply line in order to prevent flow reversal in the plurality of steam generating channels during operation of the steam generator, or a steam generator comprising:

a steam receiving vessel;

a plurality of steam generating channels that are in communication with the steam receiving vessel and that are adapted to deliver steam into the steam receiving vessel; and a steam outlet extending from the steam receiving vessel, wherein the steam receiving vessel is adapted to equilibrate fluctuations in the pressure of steam delivered into the vessel by the plurality of steam generating channels so as to provide a uniform steam pressure at the steam outlet.

12. Use to generate steam in a fuel cell system of a steam generator system comprising:

a steam generator comprising a plurality of steam generating channels; and water supply lines in communication with respective steam generating channels for supplying water to the steam generating channels, wherein each water supply line includes means for providing a pressure drop across each water supply line in order to prevent flow reversal in the plurality of steam generating channels during operation of the steam generator, or of a steam generator comprising:

a steam receiving vessel;

a plurality of steam generating channels that are in communication with the steam receiving vessel and that are adapted to deliver steam into the steam receiving vessel; and a steam outlet extending from the steam receiving vessel, wherein the steam receiving vessel is adapted to equilibrate fluctuations in the pressure of steam delivered into the vessel by the plurality of steam generating channels so as to provide a uniform steam pressure at the steam outlet.

13. Use according to claim 12, wherein the steam that is generated is delivered to a venturi where it is used to entrain gaseous fuel to produce a fuel/steam mixture.

14. A steam generator system comprising:

a steam generator comprising a plurality of steam generating channels; and water supply lines in communication with respective steam generating channels for supplying water to the steam generating channels, wherein each water supply line includes means for providing a pressure drop across each water supply line in order to prevent flow reversal in the plurality of steam generating channels during operation of the steam generator, wherein the steam generator delivers steam into a steam receiving vessel that comprises a steam outlet extending therefrom and that is adapted to dissipate or equilibrate fluctuations in the pressure of steam delivered into the vessel so as to provide a uniform steam pressure at the steam outlet.

15. A method of generating steam for use in a fuel cell system, which method comprises heating water in a steam generator comprising a plurality of steam generating channels, wherein water is supplied at a constant rate to each steam generating channel through respective water supply lines, and wherein a sufficient pressure drop is provided across each water supply line in order to prevent flow reversal in the plurality of steam generating channels, wherein the steam generator delivers steam into a steam receiving vessel that comprises a steam outlet extending therefrom and that is adapted to dissipate or equilibrate fluctuations in the pressure of steam delivered into the vessel so as to provide a uniform steam pressure at the steam outlet.

16. A method according to claim 15 wherein, the pressure drop across each water supply line follows a linear relationship with flow rate.

17. A method according to claim 15, wherein the pressure drop across the steam generator follows a linear relationship with flow rate.

18. A method according to claim 15, wherein the ratio of the pressure drop across each water supply line ($\Delta P_{supply}$) to the pressure drop across the steam generator ($\Delta P_{generator}$) is from 1:2 to 1:5.

19. A method according to claim 15, wherein the pressure drop across each water supply line is provided by delivering water to each steam generating channel through a capillary.

20. A method according to claim 15, wherein the water is supplied to each water supply line at a constant rate using a flow control valve.

21. A method according to claim 20, wherein a single valve controls the flow of water to each and every water supply line.

* * * * *